US005560042A

United States Patent [19]

Schlesner

[11] Patent Number: 5,560,042

[45] Date of Patent: Oct. 1, 1996

[54] RIDING CLOTHES PROTECTOR

[76] Inventor: Heather A. Schlesner, W. 2260 County Rd., Elkhorn, Wis. 53121

[21] Appl. No.: 556,166

[22] Filed: Nov. 9, 1995

[51] Int. Cl.[6] ..... A41D 27/12

[52] U.S. Cl. ..... 2/46; 2/22; 2/242

[58] Field of Search ..... 2/2, 46, 22, 23, 2/48, 47, 51, 69, 214, 227, 228, 232, 242, 243.1, 908, 911, 914, 919, 114

[56] References Cited

U.S. PATENT DOCUMENTS

| | | | |
|---|---|---|---|
| 4,068,315 | 1/1978 | Rainville | 2/114 |
| 4,258,440 | 3/1981 | McGowan | 2/227 |
| 4,651,353 | 3/1987 | Walden | 2/114 |

*Primary Examiner*—C. D. Crowder
*Assistant Examiner*—Gloria Hale

[57] ABSTRACT

A riding clothes protector including a right panel having a right top finger, a right middle finger, and a right bottom finger. The right panel has a right bottom portion, a right back portion, and a front side portion, with a plurality of fasteners. The right top finger has a fastener attached. The right bottom finger has a couple of fasteners adjacent a right bottom finger. Included is a left panel with a left top finger, a left middle finger, and a left bottom finger. The left panel has a left bottom portion, a left back portion, and a front side portion, with a plurality of fasteners thereon. The left top finger has a plurality of fasteners attached. Each of the fasteners of the left top finger is capable of coupling with the fastener of the right finger, when the right top finger overlaps the left top finger. The left back and the right back are permanently stitched together. The left bottom finger and right bottom finger are pulled between the rider's legs, with each bottom finger wrapping around the respective leg.

7 Claims, 3 Drawing Sheets

RIDING CLOTHES PROTECTOR

BACKGROUND OF THE INVENTION

1. Field of the Invention

The present invention relates to a riding clothes protector and more particularly pertains to a wrap-around protective covering of riding breeches and boots when worn by a rider, and further allowing easy removal of the riding clothes protector by using snap-type fasteners to secure the riding clothes protector over the rider's breeches 2. Description of the Prior Art The use of absorbent riding clothes protectors is known in the prior art. More specifically, protective chaps heretofore devised and utilized for the purpose of wearing over trousers are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,095,544 to Elverskog discloses a protective chaps. U.S. Pat. No. 5,033,124 to Bucaleo et al. discloses a zipperless chaps. U.S. Pat. No. 4,984,303 to Ross discloses a rain chaps. U.S. Pat. No. 4,843,654 to Harch discloses a riding pants. U.S. Pat. No. Des. 344,620 to Lavell discloses a chaps. Lastly, U.S. Pat. No. Des. 321,969 to Upthegrove, Jr. and Hontgomery, Jr. discloses a pair of chaps.

While these devices fulfill their respective, particular objectives and requirements, the aforementioned patents do not describe riding clothes protector that is easily wrapped around the waist, the legs, and the upper boot portion of the rider, and has snap-type fasteners to secure the riding protector around the body of the rider.

In this respect, the riding clothes protector according to the present invention substantially departs from the conventional concepts and designs of the prior art, and in doing so provides an apparatus primarily developed for the purpose of a wrap-around protective covering of riding breeches and boots when worn by a rider, further allowing for easy removal of the riding clothes protective by using snap-type fasteners to secure the riding protector on the rider's breeches.

Therefore, it can be appreciated that there exists a continuing need for a new and improved riding clothes protector which can be used for a wrap-around protective covering of riding breeches and boots when worn by a rider, further allowing for easy removal of the riding clothes protective by using snap-type fasteners to secure the riding protector on the rider's breeches. In this regard, the present invention substantially fulfills this need.

SUMMARY OF THE INVENTION

In view of the foregoing disadvantages inherent in the known types of protective chaps now present in the prior art, the present invention provides an improved riding clothes protector. As such, the general purpose of the present invention, which will be described subsequently in greater detail, is to provide a new and improved riding clothes protector and method which has all the advantages of the prior art and none of the disadvantages.

To attain this, the present invention essentially comprises an amoeba-like right panel. The right panel has three finger-like projections, a right bottom portion, and a right back portion. The right panel has a front side and a back side. The front side of the right panel has a plurality of snap-type fastener assemblies thereon. The finger-like projections forming a right top finger, a right middle finger, and a right bottom finger. The right top finger has a snap-type fastener assembly attached thereto and spaced from a right top finger tip. The right bottom finger is thirty-five percent longer than the right top finger. The right bottom finger is fifty percent longer than the right middle finger. The right bottom finger has a couple of snap-type fastener assemblies adjacent a right bottom finger tip and positioned thereon. The right bottom portion has a corner with a pile-type fastener assembly coupled to the back side thereof. Also included is an amoeba-like left panel. The left panel has three finger-like projections, a left bottom portion and a left back portion. The left panel has a front side and a back side. The front side of the left panel has a plurality of snap-type fastener assemblies thereon. A suspender-type clip is attached to the front side of the left panel. The clip is spaced from the snap-type fastener assemblies and to the left back portion of the left panel. The finger-like projections form a left top finger, a left middle, and a left bottom finger. The left top finger has a plurality of snap-type fastener assemblies attached thereto and spaced from a left top finger tip. Each of the snap-type fastener assemblies of the left top finger are capable of coupling with the snap-type fastener assembly of the right top finger. The left bottom finger is thirty-five percent lower than the left top finger. The left bottom finger is fifty percent longer than the left middle. The left bottom finger has a couple of snap-type fastener assemblies adjacent a left bottom finger tip and is positioned thereon. The left bottom portion has a corner with a pile-type fastener assembly coupled to the back side thereof. The left back portion and the right back portion are permanently stitched together and positioned near a lower back of a horse rider. The right top finger is capable of lapping over the left top finger for coupling slightly below a waist of a rider when the left and right back portions of each panel are attached. The right bottom finger is pulled between the rider's legs for coupling with two of each of the snap-type fastener assemblies of the right panel, when the back portion of each panel are attached. The left bottom finger is pulled between the rider's legs for coupling with two of each of the snap-type fastener assemblies of the left panel when the back portions of each panel are attached. Lastly, a generally rectangular pocket with a top flap and three exterior pouches thereon is included. The pocket is attached to the front side of the right panel. The pocket has a length of six inches and a width of four inches. The top flap of the pocket is twenty-five percent of the pocket's length.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved riding clothes protector which has all of the advantages of the prior art protective chaps and none of the disadvantages.

It is another object of the present invention to provide a new and improved riding clothes protector which may be easily and efficiently manufactured and marketed.

It is further object of the present invention to provide a new and improved riding clothes protector which is of durable and reliable constructions.

An even further object of the present invention is to provide a new and improved riding clothes protector which is susceptible of a low cost of manufacture with regard to both materials and labor, and which accordingly is then susceptible of low prices of sale to the consuming public, thereby making such riding clothes protector economically available to the buying public.

Still yet another object of the present invention is to provide a new and improved riding clothes protector which provides in the apparatuses and methods of the prior art some of the advantages thereof, while simultaneously overcoming some of the disadvantages normally associated therewith.

Even still another object of the present invention is to provide a new and improved riding clothes protector for a wrap-around protective covering of riding breeches and boots when worn by a rider, further allowing for easy removal of the riding clothes protective by using snap-type fasteners to secure the riding protector on the rider's breeches.

Lastly, it is an object of the present invention to provide a new and improved riding clothes protector that includes a right panel. The right panel has a right top finger, and a right middle finger, and a right bottom finger. The right panel has a right bottom portion, a right back portion, and a front side with a plurality of snap-type fastener assemblies thereon. The right top finger has a snap-type fastener assembly attached thereto. The right bottom finger has a couple of snap-type fastener assemblies adjacent a right bottom finger tip. Included is a left panel. The left panel has a left top finger, a left middle finger, and a left bottom finger. The left panel has a left bottom portion, a left back portion, and a front side with a plurality of snap-type fastener assemblies thereon. The left top finger has a plurality of snap-type fastener assemblies attached thereto. Each of the snap-type fastener assemblies of the left top finger is capable of coupling with the snap-type fastener assembly of the right top finger, when the right top finger overlaps the left top finger. The left back portion and the right back portion are permanently stitched together. The left bottom finger is pulled between the rider's legs at the same time the right bottom finger is pulled between the rider's legs with each bottom finger wrapping around the respective leg when each back portion is attached.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
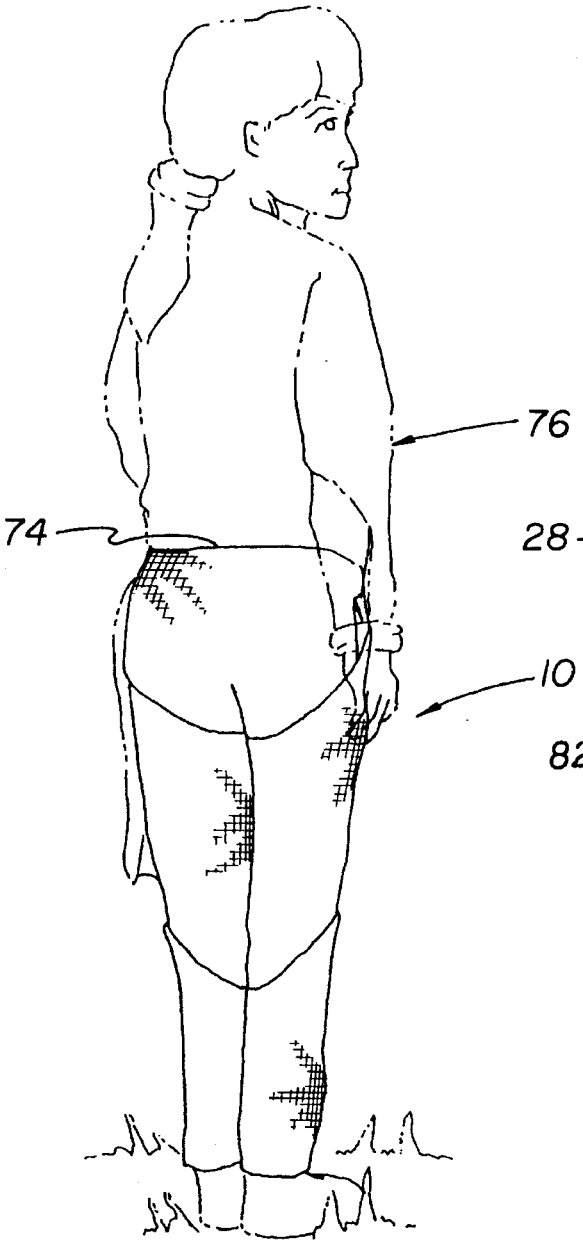
FIG. 1 is a perspective view of the rear of the preferred embodiment of the riding clothes protector constructed in accordance with the principles of the present invention.

With reference now to the drawings, and in particular to FIG. 1 thereof, the preferred embodiment of the new and improved riding clothes protector embodying the principles and concepts of the present invention and generally designated by the reference numeral 10 will be described.

The present invention, the riding clothes protector 10 is comprised of a plurality of components. Such components in their broadest context include a right panel, a left panel, and snap-type fasteners. Such components are individually configured and correlated with respect to each other so as to attain the desired objective.

Figure 3:
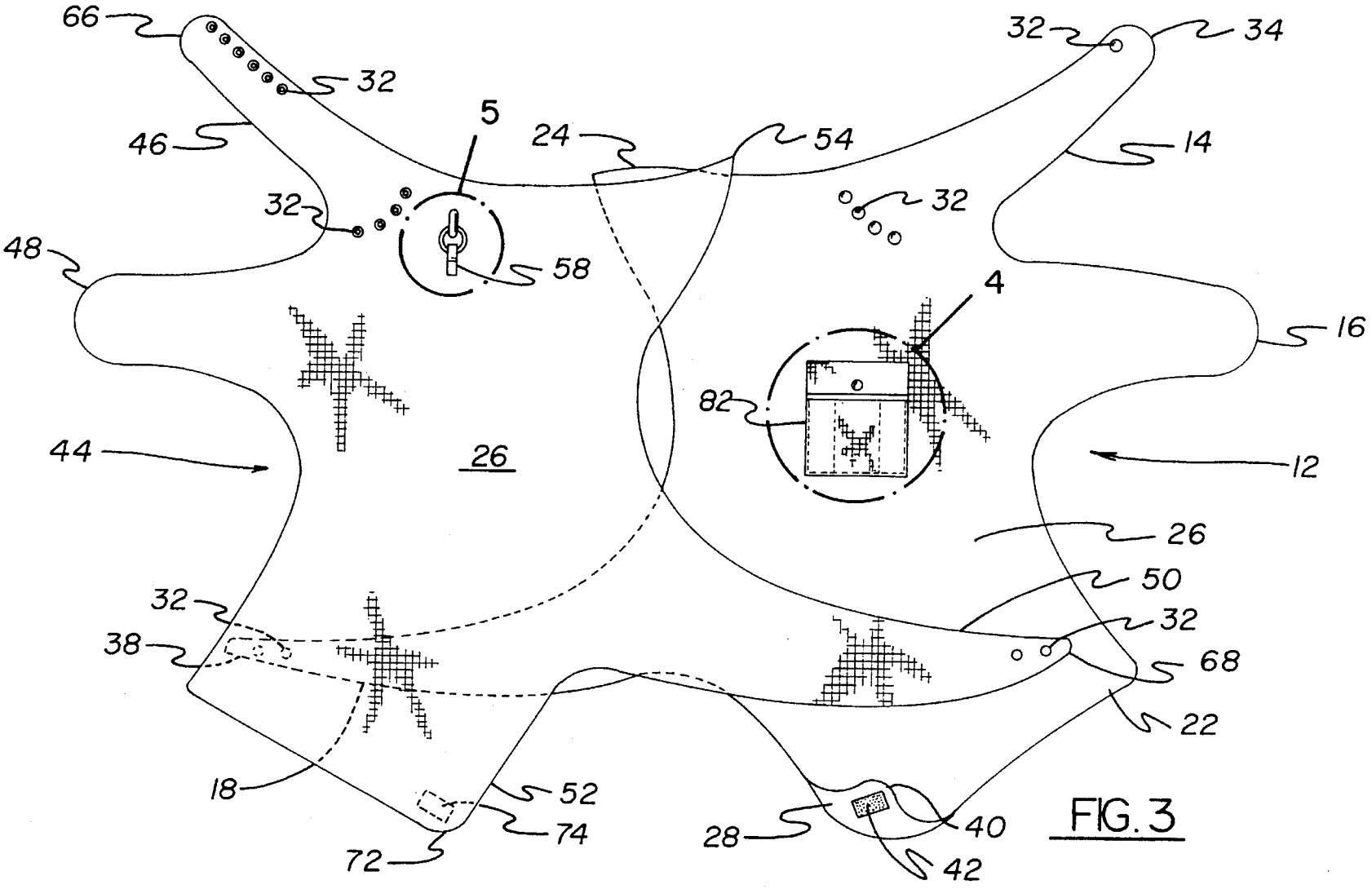
FIG. 3 is a top plan view of the unwrapped riding clothes protector in an operable configuration.

Specifically, the present invention includes an amoeba-like right panel 12, as shown in FIG. 3. The right panel has three finger-like projections 14, 16, and 18, a right bottom portion 22 and a right back portion 24. The right panel has a front side 26 and a back side 28. The front side of the right panel has a plurality of snap-type fastener assemblies 32 thereon. The finger-like projections form a right top finger 14, a right middle finger 16, and a right bottom finger 18. The right top finger has a snap-type fastener assembly 32 attached thereto and spaced from a right top finger tip 34. Each finger has a decreasing width as each finger extends from the body of the right panel.

The right bottom finger 18 is thirty-five percent longer than the right top finger 14. The right bottom finger is fifty percent longer than the right middle finger 16. The right bottom finger has a couple of snap-type fastener assemblies 32 adjacent a right bottom finger tip 38 and positioned thereon. The right bottom portion has a corner 40 with a pile-type fastener assembly 42 coupled to the back side thereof.

Figure 2:
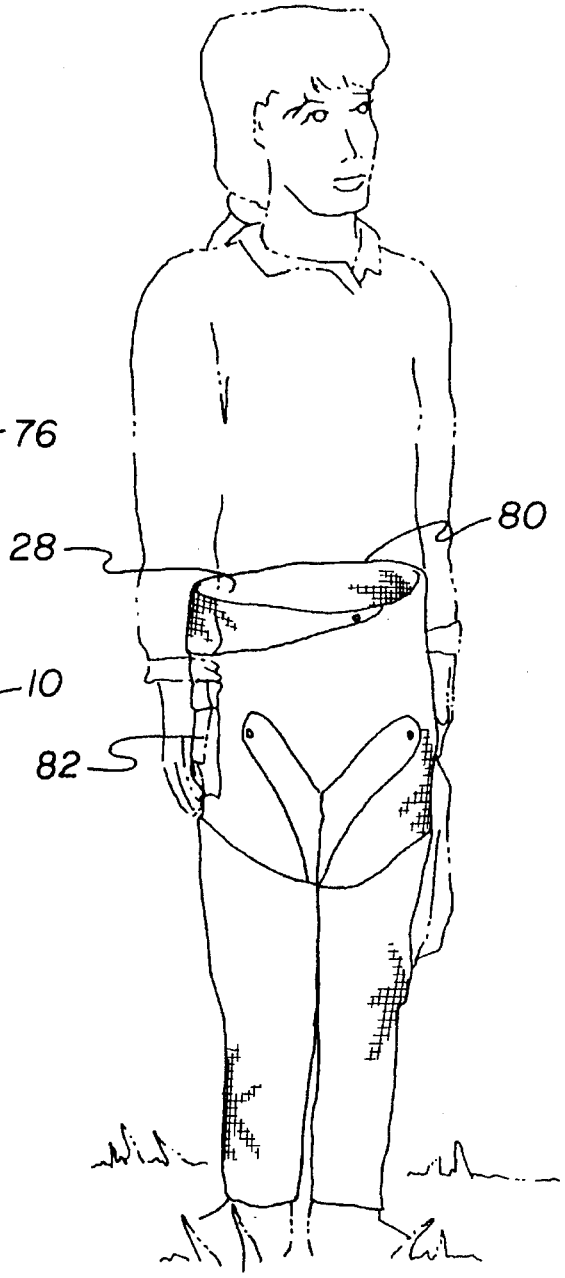
FIG. 2 is a perspective view of the front of the preferred embodiment of the riding clothes protector constructed in accordance with the principles of the present invention.
Figure 5:
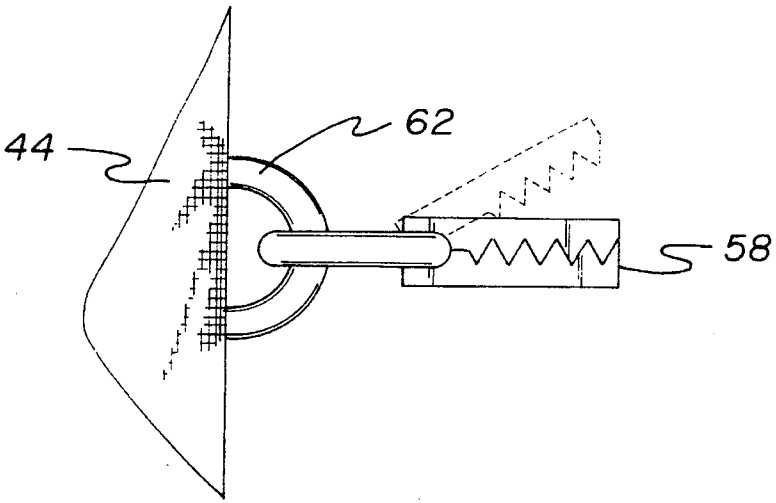
FIG. 5 is an enlarged view of the clip as shown at position 5 of FIG. 3.

As best illustrated in FIG. 3, an amoeba-like left panel 44 is included. The left panel has three finger-like projections 46, 48, and 50, a left bottom portion 52, and a left back portion 54, the left panel has a front side 26 and a back side 28 as shown in FIG. 2. The front side of the left panel has a plurality of snap-type fastener assemblies 32 thereon. A suspender-type clip 58, as shown in FIG. 5, is attached to the front side of the left panel. The clip is spaced from the snap-type fastener assemblies and the left back portion of the left panel. The clip is attached to the left panel by a ring 62.

The finger-like projections, of the left panel form a left top finger 46, a left middle finger 48, and a left bottom finger 50. The left top finger has a plurality of snap-type fastener assemblies 32 attached thereto and spaced from a left top finger tip 66. Each finger has a decreasing width as each finger extends from the body of the left panel 44. Each of the snap-type fastener assemblies of the left top finger 46 is coupled with the snap-type fastener assembly of the right top finger 14. The left bottom finger 50 is thirty-five percent longer than the left top finger 46 and fifty percent longer than the left middle finger 48. The left bottom finger has a couple of snap-type fastener assemblies 32 adjacent a left bottom finger tip 68 and is positioned thereon. The left bottom portion has a corned 72 with a pile-type fastener assembly 74 coupled to the back side 28 thereof.

The left back portion 54 and the right back portion 24, of FIG. 3, are permanently stitched together and positioned near a lower back 74 of a horse rider 76 of FIG. 1. The right top finger 14 lapping over the left top finger 46 to coupling slightly below a waist 80 of a rider 7, of FIG. 2, when the left and right back portions of each panel are attached. The right bottom 18 finger is pulled between the rider's legs for coupling with two of each of the snap-type fastener assemblies of the right panel, when the back portions of each panel are attached. The left bottom finger 50 is pulled between the rider's legs for coupling with two of each of the snap-type fastener assemblies of the left panel when the back portions of each panel are attached. It is important that the left and right bottom finger wraps around the rider's legs from the rear so that the rider is comfortable with additional covering over the riding breeches. Additionally, this wrapping method will ensure that the riding clothes protector does not slip off the rider when the rider is in competitive equestrian events.

As shown in FIGS. 1 and 2, the right bottom portion of the right panel wraps around the boot of the rider while the left bottom portion of the left panel is around the left boot of the rider. Pile-type fastener assemblies are used to couple one corner of each bottom portion to the other corner. Pile-type fasteners used along the bottom portions of the left and right panels are easy to remove, so as to allow the rider to quickly remove the riding clothes protector prior to mounting the horse for the competitive equestrian event. The pile-type fastener assemblies of the bottom portions of the left and right panel further allow the rider ease of unwrapping both bottom portions when a boot adjustment needs to made between rides.

Figure 4:
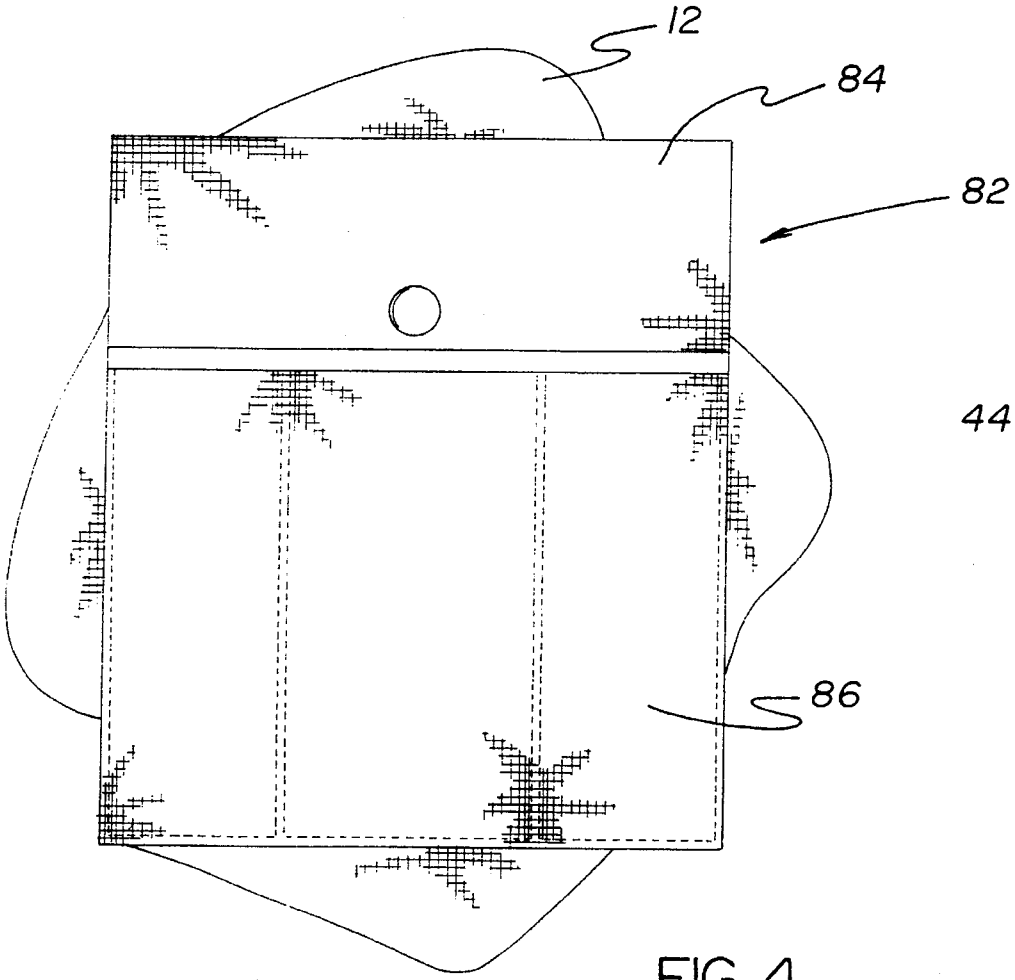
FIG. 4 is an enlarged view of the pocket as shown at position 4 on FIG. 3.

Lastly, as shown in FIG. 4, a generally rectangular pocket 82 is included. The pocket has a top flap 84 and three exterior pouches 86 thereon. The pocket is attached to the front side of the right panel. The pocket has a length of six inches and a width of four inches. The top flap is twenty-five percent of the length. The exterior pouches are about seventy percent of the length. The pouch can house horse braiding utensils such as, a pulling comb, a wire pull-through, and a main clip in any one of the exterior pouches. The pocket is sized to carry the test booklet during and equestrian competition.

The present invention is a riding clothes protector that is worn over riding breeches and boots. The riding clothes protector has a right and left panel. Each panel is capable of being wrapped around the respective leg of the rider. Each panel has a top finger. The top fingers are wrapped around the waist area of the rider and coupled to snap-type fasteners positioned thereon. Each panel also has a bottom portion with a pile-type fastener assembly on a corner of the bottom portion. Each bottom portion of the panel is wrapped around the lower leg and upper portion of the rider's boots, and the corners are coupled together with the pile-type fastener. The riding clothes protector is easy to put on and remove because it has snap-type fasteners and pile-type fastener on each panel. The riding clothes protector is formed from a stretchable fabric and can be produced in a variety of colors. The snap-type fasteners that are placed on the riding clothes protector are decorative snaps that enhance the appearance of the riding clothes protector. The clip that is on the left panel of the riding clothes protector is formed of stainless steel. The clip may be used to hold the rider's towel. The rider, by using the riding clothes protector, allows the show breeches to remain clean throughout an equestrian competition. Additionally, the riders appearance is a factor considered during a competition, and the present invention can improve the judge's impression of the riders appearance. The present invention reduces wear and tear on the show breeches by covering them between rides.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A riding clothes protector for placement over riding trousers and boots of a horse rider comprising in combination:

a right panel having three finger projections, a right bottom portion and a right back portion, the right panel having a front side and a back side, the front side of the right panel having a plurality of snap-type fastener assemblies thereon, the finger projections forming a right top finger, a right middle finger and a right bottom finger, the right top finger having a snap-type fastener assembly attached thereto and spaced from a right top finger tip;

the right bottom finger being thirty-five percent longer than the right top finger and fifty percent longer than the right middle finger, the right bottom finger having a couple of snap-type fastener assemblies adjacent a right bottom finger tip and positioned thereon, the right bottom portion having a corner with a pile-type fastener assembly coupled to the back side thereof;

a left panel having three finger projections, a left bottom portion and a left back portion, the left panel having a front side and a back side, the front side of the left panel having a plurality of snap-type fastener assemblies thereon, a suspender type clip being attached to the front side of the left panel, the clip being spaced from the snap-type fastener assemblies and the left back portion;

the finger projections forming a left top finger, a left middle finger and a left bottom finger, the left top finger having a plurality of snap-type fastener assemblies attached thereto and spaced from a left top finger tip, each of the snap-type fastener assemblies of the left top finger being capable of coupling with the snap-type fastener assembly of the right top finger, the left bottom finger being thirty-five percent longer than the left top finger and fifty percent longer than the left middle finger, the left bottom finger having a couple of snap-type fastener assemblies adjacent a left lower finger tip and positioned thereon, the left bottom portion having a corner with a pile-type fastener assembly coupled to the back side thereof;

the left back portion and the right back portion capable of being permanently stitched together and positioned near a lower back of a horse rider when worn, the right top finger being lapped over the left top finger for coupling slightly below a waist of the rider when the left and right back portions of each panel are attached, the right bottom finger being pulled between the rider's legs for coupling with two of each of the snap-type fastener assemblies of the right panel when the back portions of each panel are attached, the left bottom finger being pulled between the rider's legs for coupling with two of each of the snap-type fastener assemblies of the left panel when the back portions of each panel are attached; and a generally rectangular pocket having a top flap and three exterior pouches thereon, the pocket being attached to the front side of the right panel, the pocket having a length of 6 inches and a width of 4 inches with the top flap being twenty-five percent of the length.

2. A riding clothes protector comprising:

a right panel having a right top finger, a right middle finger and a right bottom finger, the right panel having a right bottom portion, a right back portion and a front side with a plurality of snap-type fastener assemblies thereon, the right top finger having a snap-type fastener assembly attached thereto, the right bottom finger having a couple of snap-type fastener assemblies adjacent a right bottom finger tip;

a left panel having a left top finger, a left middle finger and a left bottom finger, the left panel having a left bottom portion, a left back portion, and a front side with a plurality of snap-type fastener assemblies thereon, the left top finger having a plurality of snap-type fastener assemblies attached thereto, each of the snap-type fastener assemblies of the left top finger being coupled with the snap-type fastener assembly of the right top finger when the right top finger is over lapping the left top finger; and the left back portion and the right back portion being permanently stitched together, the left bottom finger being pulled between the rider's legs at the same time the right bottom finger is pulled between the rider's legs with each bottom finger wrapping around the respective leg when each back portion is attached.

3. The riding clothes protector as set forth in claim 2 wherein the right panel has a back side and the right bottom portion has a corner with a pile-type fastener assembly coupling the back side thereof, and the right bottom finger being thirty-five percent longer than the right top finger and fifty percent longer than the right middle finger.

4. The riding clothes protector as set forth in claim 2 wherein the left panel has a back side and the left bottom portion has a corner with a pile-type fastener assembly coupling the back side thereof, and a suspender type clip being attached to the front side of the left panel, the clip being spaced from the snap-type fastener assemblies of the left panel.

5. The riding clothes protector as set forth in claim 2 wherein the left bottom finger has a couple of snap-type fastener assemblies adjacent a left bottom finger tip, the left bottom finger being thirty-five percent longer than the left top finger and fifty percent longer than the left middle finger.

6. The riding clothes protector as set forth in claim 2 wherein the right top finger couples the left top finger slightly below a waist of the rider, when the left and right back portions of each panel are attached, and securing each panel around the waist of the rider, the right bottom finger when positioned between the rider's legs couples two each of the snap-type fasteners assemblies of the right panel, while the left bottom finger, when positioned between the rider's legs, couples with two of each of the snap-type fastener assemblies of the left panel.

7. The riding clothes protector as set forth in claim 6 wherein a generally rectangular pocket having a top flap and three exterior pouches attached to the front side of the right panel, the pocket having a length of 6 inches and a width of 4 inches with the top flap being twenty-five percent of the length.

* * * * *